US007107645B2

(12) United States Patent
Bressler et al.

(10) Patent No.: US 7,107,645 B2
(45) Date of Patent: Sep. 19, 2006

(54) SUEDE SHOE BRUSH

(76) Inventors: Peter Bressler, 816 S. 10th St., Philadelphia, PA (US) 19147; John Coleman, 4650 Sheldon Ave., Philadelphia, PA (US) 19127; Mathieu Turpault, 409 Berwyn Baptist Rd., Berwyn, PA (US) 19312; Zoey Juhng, 337 S. 21st St., Apartment 1R, Philadelphia, PA (US) 19103; Xavier Vinas, 3422 Hamilton St., #2, Philadelphia, PA (US) 19104

( * ) Notice: Subject to any disclaimer, the term of this patent is extended or adjusted under 35 U.S.C. 154(b) by 260 days.

(21) Appl. No.: 10/396,109

(22) Filed: Mar. 25, 2003

(65) Prior Publication Data

US 2004/0088809 A1 May 13, 2004

Related U.S. Application Data

(63) Continuation-in-part of application No. 29/170,757, filed on Nov. 12, 2002, now Pat. No. Des. 479,405.

(51) Int. Cl.
*B25F 1/00* (2006.01)

(52) U.S. Cl. ..... 15/105.52; 15/107; 15/114; 15/118; 15/237; D4/130

(58) Field of Classification Search ..... 15/107, 15/105, 114, 118, 161, 237, 112, 106, 143.1, 15/160, 159.1, 176, 105.51, 105.52; D4/130, D4/135, 199, 107
See application file for complete search history.

(56) References Cited

U.S. PATENT DOCUMENTS

| | | | | |
|---|---|---|---|---|
| 60,886 | A | 1/1867 | Hamilton | |
| 108,108 | A | 10/1870 | Combs | |
| 1,889,675 | A | 11/1932 | Lindewall | |
| D110,570 | S | 7/1938 | Laird | |
| 2,493,074 | A * | 1/1950 | Korody | 132/312 |
| D182,580 | S | 4/1958 | Frederickson | D9/2 |
| 3,039,435 | A * | 6/1962 | Meyer | 15/105.52 |
| 3,129,448 | A * | 4/1964 | Mittman | 15/1.51 |
| D245,948 | S | 10/1977 | Wolff | D4/14 |
| 4,399,580 | A | 8/1983 | Stark | 15/107 |
| D281,035 | S | 10/1985 | Herzfeld | D4/102 |
| D289,109 | S | 4/1987 | Buecheler et al. | D4/114 |
| D305,480 | S | 1/1990 | Yuen | D4/102 |
| D307,216 | S | 4/1990 | Yuen | D4/102 |
| D313,088 | S | 12/1990 | Her | D28/25 |
| 5,213,430 | A | 5/1993 | Pandola | 401/137 |
| 5,437,075 | A | 8/1995 | Peake | 15/161 |
| D364,275 | S | 11/1995 | Lewkowicz | D4/119 |
| D372,585 | S | 8/1996 | Zoccolillo et al. | D4/124 |
| 5,596,785 | A | 1/1997 | Park | 15/114 |
| D389,318 | S | 1/1998 | Williams | D4/130 |
| 5,809,604 | A * | 9/1998 | Olstyn | 15/111 |

(Continued)

*Primary Examiner*—Richard Crispino
*Assistant Examiner*—Abraham Bahta

(57) ABSTRACT

A brush for suede shoes, or any other object made of napped material, hasving a one-piece molded plastic handle having a hollow interior with a planar outwardly-facing bristle-mounting surface, a collar extending annularly about the bristle-mounting surface and a gripping portion extending centrally from the collar transversely oppositely of the bristle-mounting surface. Bristles are embedded in and extend outwardly from the bristle-mounting surface. A hollow removable erasing rubber sleeve is configured for essentially complemental fitting over the gripping portion. Paired apertures and protrusions fit together to retain the hollow removable erasing rubber sleeve in complemental contact overlying the gripping portion of the handle of the brush.

36 Claims, 3 Drawing Sheets

U.S. PATENT DOCUMENTS

| | | | | |
|---|---|---|---|---|
| 5,865,554 | A | 2/1999 | Lin | 401/206 |
| D413,445 | S | 9/1999 | deBlois et al. | D4/138 |
| 5,978,999 | A | 11/1999 | deBlois et al. | 15/22.1 |
| D417,789 | S | 12/1999 | Murphy et al. | D4/102 |
| 6,032,316 | A | 3/2000 | Peake et al. | 15/161 |
| D425,707 | S | 5/2000 | Olsson | D4/119 |
| D433,817 | S | 11/2000 | Stark | D4/119 |
| D439,414 | S | 3/2001 | Birdwell | D4/119 |
| 6,363,567 | B1 | 4/2002 | Woodward | 15/161 |

* cited by examiner

SUEDE SHOE BRUSH

CROSS-REFERENCE TO RELATED PATENT APPLICATION

This application is a continuation in part of U.S. design patent application 29/170,757 filed 12 Nov. 2002 now U.S. Pat. No. D.479,405 and assigned to Shoe Store Supplies, Inc. The extent the instant application has subject matter in common with Ser. No. 29/170,757, the same is incorporated by reference and the priority of the 12 Nov. 2002 filing date is claimed under 35 USC 120.

BACKGROUND OF THE INVENTION

1. Field of the Invention

The present invention relates to brushes and to brushes for cleaning mud and debris from suede, more particularly, the invention relates to brushes to clean shoes made, in part or in whole, of suede.

2. Description of the Prior Art

The shoe brush art and the suede brush art are both well-developed. Numerous United States patents have been issued for various brushes, some of which are for suede, while others of which are for shoes. Known to applicant are U.S. Pat. Nos. D281,035; D289,109; D305,480; D307,216; D355,734. D364,275; D372,585; D389,318; D413,445; D425,707; D433,817; D439,414; U.S. Pat. Nos. 4,399,580; 5,213,430; 5,437,075; 5,596,785; 5,865,554; 5,978,999 and 6,032,316.

SUMMARY OF THE INVENTION

This invention provides a brush, which in one of its aspects is a brush for suede shoes, where the brush includes a preferably one-piece, preferably molded plastic handle, preferably having a hollow interior. The handle includes a preferably planar, outwardly-facing bristle-mounting surface, a collar extending annularly around the bristle-mounting surface, and a gripping portion extending centrally from the collar in a direction transverse to and oppositely from the bristle-mounting surface.

In one aspect of the invention, the gripping portion preferably has three generally vertically-extending surfaces, two of which are preferably parallel and spaced from one another, with the third surface joining each of the parallel surfaces. The gripping portion preferably further includes a convex, curved fourth surface extending upwardly and transitioning into the third surface at a position maximally remote from the bristle-mounting surface. The parallel spaced surfaces each preferably include generally centrally positioned exteriorly facing surface portions raised from the area therearound with the central surface portions including areas of depression formed in the raised surface portions. The areas of depression facilitate manual gripping of the brush. The fourth surface preferably includes a plurality of transversely extending protrusions formed thereon. The protrusions are preferably substantially equally spaced from one another along the fourth surface from the collar to the transition into the third surface.

In this aspect of the invention, the brush further includes bristles preferably embedded in and extending outwardly from the bristle-mounting surface. In this aspect of the invention, the brush preferably further includes a hollow, removable, rubber erasing sleeve configured with interior surfaces substantially matching the surfaces of the gripping portion of the handle. The hollow, removable rubber sleeve is shaped and sized for essentially complemental fitting over the gripping portion of the handle and for complementary contacting the annular collar. The sleeve preferably includes apertures in the parallel surfaces which are sized for complemental fitting about the raised exteriorly facing surface portions of the parallel spaced surfaces of the gripping portion. The fourth surface of the sleeve preferably includes a plurality of transversely extending sacrificial protrusions thereon, substantially equally spaced from one another along the fourth surface and proximate the juncture of the fourth surface with the collar. The sacrificial protrusions are for erasing contact with a suede shoe surface to be cleaned.

In another one of its aspects, this invention provides a brush for suede or any other napped material (for example, but not meant to limit the invention, corduroy).

In a preferred aspect the invention provides a brush for suede shoes. The brush comprises a handle which has an outwardly facing bristle mounting surface and a gripping portion extending away from the bristle mounting surface with the handle further including at least one exterior flat surface fitment for retaining an erasing sleeve when positioned thereon, where the gripping portion includes a plurality of protrusions formed thereon for resisting sliding removal of the sleeve when positioned over the handle and engaging the fitment. In this aspect of the invention, the bristles are preferably mounted on and extend from the bristle mounting surface. In this aspect of the invention, the removable erasing sleeve is preferably configured for complementally contacting the gripping portion and includes at least one second fitment formed therein for engaging the first surface fitment of the gripping means and precluding sliding removal of the sleeve from the gripping portion.

In this second aspect of the invention, the bristles are preferably of length varying with bristle positioned along at least one direction of the mounting surface to provide a wave-like configuration of bristle ends opposite those at the mounting surface. In the second aspect, the brush preferably further includes at least one sacrificial protrusion formed on the erasing sleeve for sacrificial erasing contact with the suede shoe, or other napped material object, having a surface to be cleaned and further preferably includes a plurality of such sacrificial protrusions formed on the erasing sleeve, with the sacrificial protrusions substantially equally spaced from one another along a fourth surface (of the sleeve) proximate juncture thereof with a collar, for erasing contact with a surface to be cleaned. The sleeve is preferably rubber and the bristles are preferably embedded in the bristle mounting surface.

In yet another aspect of the invention, the sleeve includes a plurality of exteriorly facing surfaces extending away from the bristle mounting surface of the handle when the sleeve is positioned on the handle, with first and second sleeve surfaces being spaced from one another and with the third sleeve surface joining each of the first and second sleeve surfaces. A fourth sleeve surface extends upwardly and transitions into at least the third sleeve surface at a position maximally removed from the bristle mounting surface of the handle when the sleeve is positioned on the handle. In this aspect of the invention, the first and second sleeve surfaces each preferably include apertures for fitting over exteriorly facing raised portions formed on the first and second surfaces of the handle for retaining the sleeve in position complementally fitting over the handle with the fourth sleeve surface including a plurality of sacrificial cleaning protrusions formed thereon, preferably substantially equally spaced from one another along the fourth surface. In this aspect of the invention, the sleeve is preferably sized and shaped for complemental facing contact fitting over the gripping portion of the handle of the brush.

DESCRIPTION OF THE PREFERRED EMBODIMENTS AND BEST MODE KNOWN FOR PRACTICE OF THE INVENTION

Cleaning suede is difficult since suedes do not tolerate water. Commonly used methods for cleaning suede leather involve use of petroleum-based solvents in a type of dry-cleaning process. Spot removal may be accomplished using a chlorinated hydrocarbon, often applied in the form of a spray. The problem of cleaning suede, without adversely affecting it, has been recognized for a long time. Thus, there is a long felt, yet unfulfilled need for a simple, easy and safe way to clean suede, or any napped material. This invention fulfills this need by providing a brush for cleaning a textured surface, such as a grain or suede leather surface, even a heavily soiled surface. The area to be cleaned is initially rubbed, wiped, or scraped using protrusions 46 extending from the brush; resulting debris is thereafter brushed away using bristles 32.

Brushes are configured to prevent slippage of the brush from the hand during the cleaning process. Slippage may result in non-uniform cleansing of suede, or other napped material, and possibly result in a noticeable or undesirable non-smooth finish on the underlying suede or other napped material. In the invention this slippage is prevented by having a handle designed generally in a shark-tooth configuration having a shark-tooth gripping portion extending oppositely of the bristle mounting surface 12. The shark-tooth gripping portion is configured to have sloping surfaces facing outwardly from the bristle mounting surface 12 and short surfaces extending generally perpendicular to the bristle mounting surface of the brush. Thus, the gripping portion may be, in effect, clamped between the index finger and thumb thereby preventing slippage of the brush from the grip, while the brush is at the same time contoured to fit comfortably into the user's hand.

The invention further relates to a brush configured to have a gripping surface with a depression or concave portion facilitating grasp of the brush. When the brush is held with the depression or concave portion the brush provides superior holding comfort and ease-of-use.

The various objects and advantages of the present invention are more readily understood from the following detailed description when read in conjunction with the appended drawings.

Figure 7:
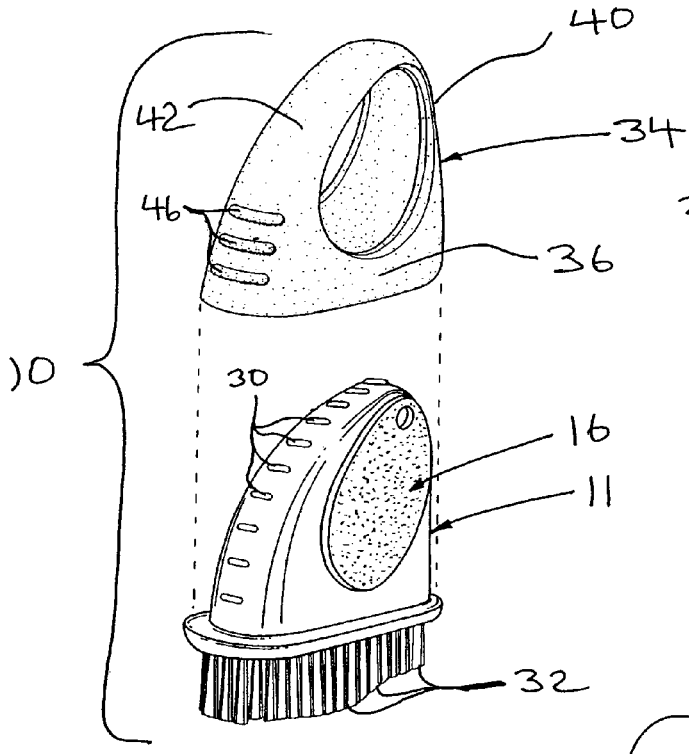
FIG. 7 is a left side perspective view of the shoe brush of the invention illustrating the removal of the eraser sleeve from the handle.
Figure 8:
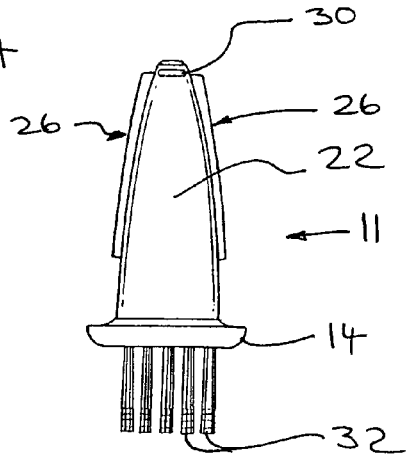
FIG. 8 is a back view of the shoe brush of the invention with the eraser sleeve removed.
Figure 9:
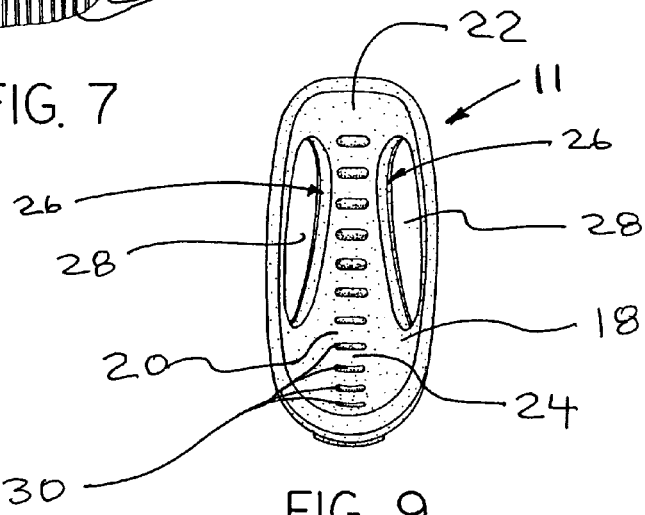
FIG. 9 is a top view of the shoe brush of the invention with the eraser sleeve removed.

Referring to the drawings in general and to FIG. 7 in particular, a brush in accordance with a preferred embodiment and best known for practice of the invention is designated generally 10 and includes a handle or body portion 11 having a bristle mounting surface 12 which is preferably planar. Handle or body portion 11 is preferably one-piece molded plastic with a hollow interior. Handle or body portion 11 further preferably includes an annular collar 14 extending entirely around bristle mounting surface 12. Handle or body portion 11 preferably yet further includes a gripping portion designated generally 16 in the drawings, which extends centrally from annular collar 14 and transversely oppositely from bristle mounting surface 12. Gripping portion 16 preferably has three generally vertically extending surfaces designated 18, 20 and 22 in the drawings with surface 18 being referred to as a handle or body portion first surface, surface 20 being referred to as a handle or body portion second surface and surface 22 being referred to as a handle or body portion third surface. First and second surfaces 18, 20 are preferably parallel to one another and spaced apart respecting one another.

Third surface 22 joins each of the two first and second parallel surfaces 18, 20 as shown in FIG. 7. A convex, curved fourth surface of handle or body portion 11 is denoted 24 and extends upwardly and transitions into third surface 22 at a position which is maximally remote from bristle mounting surface 12.

Parallel spaced first and second surfaces 18, 20 each preferably include generally centrally positioned exteriorly facing surface portions which are raised from the areas therearound with such raised central surface portions being denoted 26. Within raised central surface portions 26 are formed areas of depression or concavity with such areas denoted 28 in the drawings. Areas 28 of depression or concavity facilitate manual gripping of the brush between fingers.

Fourth surface 24 further preferably includes a plurality of preferably transversely extending protrusions 30 formed thereon, with protrusions 30 preferably being substantially equally spaced from one another along fourth surface 24 from annular collar 14 to the location of transition of fourth surface 24 into third surface 22.

Brush 10 further includes a plurality of bristles 32 which are preferably embedded in and in any event are mounted on bristle mounting surface 12 and extend outwardly away therefrom, preferably transversely to bristle mounting surface 12. In one aspect of the invention the ends of bristles 32 are frayed, leading to less abrasive bristle surfaces, thereby reducing the likelihood of scratching the surface to be cleaned. However, the invention embracing bristles 32 being more rigid in versions of one brush designed for heavier duty cleaning.

Figure 1:
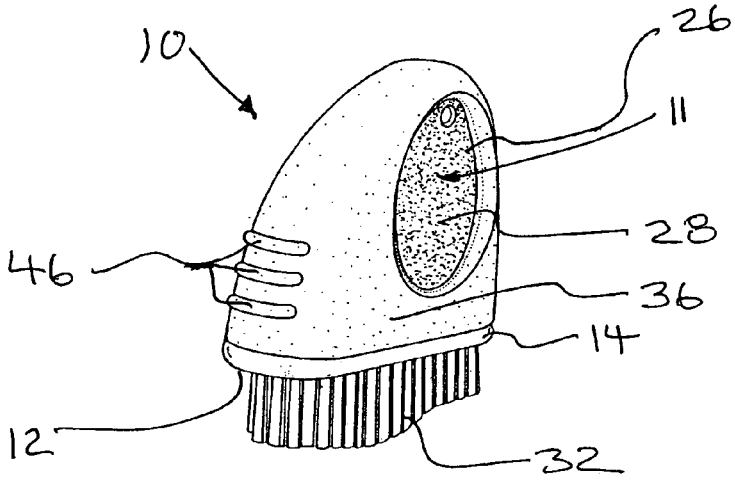
FIG. 1 is a left side perspective view of the shoe brush of the invention.
Figure 2:
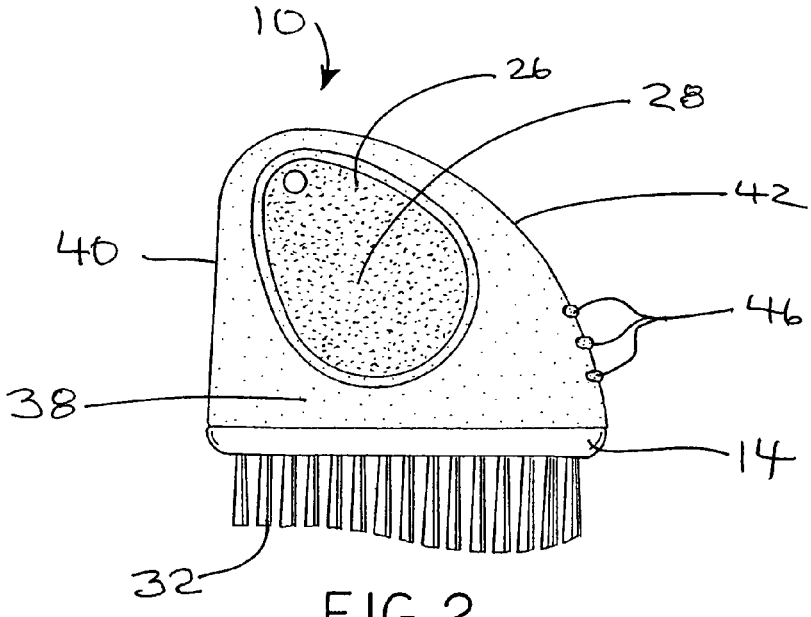
FIG. 2 is a right side view of the shoe brush of the invention.
Figure 3:
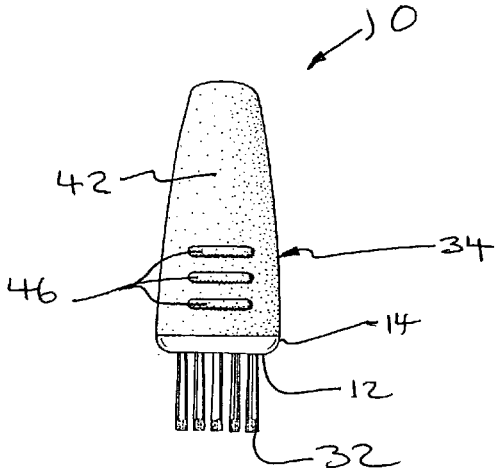
FIG. 3 is a front view of the shoe brush of the invention.
Figure 4:
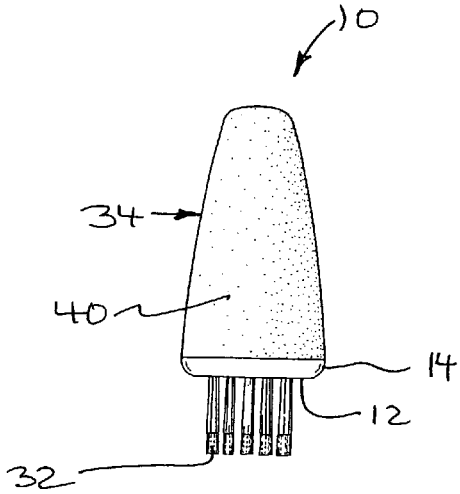
FIG. 4 is a back view of the shoe brush of the invention.
Figure 5:
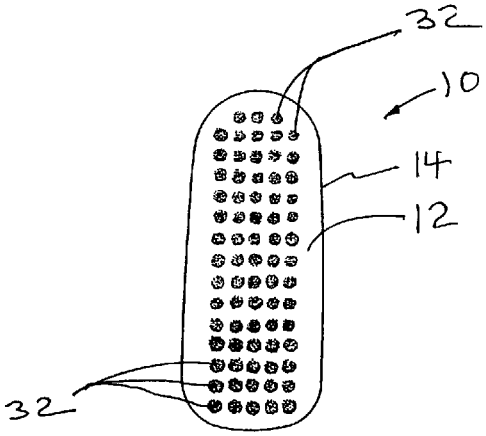
FIG. 5 is a bottom view of the shoe brush of the invention.
Figure 6:
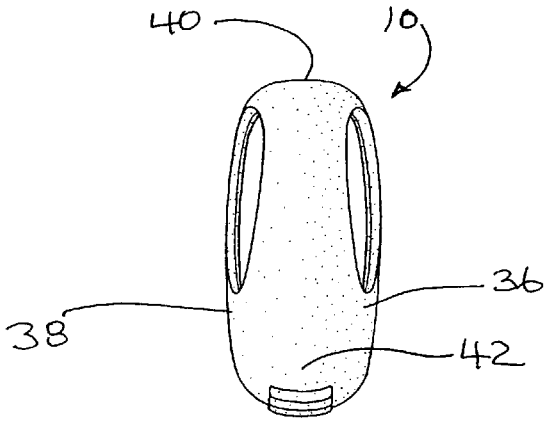
FIG. 6 is a top view of the shoe brush of the invention.

A bristle mounting surface 12 of the brush 10 holds multiple bristles 32. In the one aspect, bristles 32 are arranged in the bristle mounting surface 12 to form a substantially flat bristle surface. In yet another aspect of the invention a curved bristle surface is provided wherein the bristle ends form a wave-like configuration, as shown in FIG. 2.

The brush according to the invention may be made from any materials commonly used in the art. The bristles 32 may be made from a flexible material suitable for use on suede or other napped material. Generally, materials suitable for bristles 32 include, but are not limited to, polyamides such as nylon or polyesters such as polybutylene terephthalate. The diameter of the brush bristles is preferably about 0.15 mm to about 0.35 mm.

Brush 10 preferably further includes a hollow removable erasing sleeve 34 which is preferably highly flexible and fabricated of rubber. The rubber of brush 10 can be thermoplastic elastomers (TPE). As used herein TPE denotes any of a family of polymers that resemble elastomers in that they are highly resilient and can be repeatedly stretched to at least twice their initial lengths with full rapid recovery, but are true thermoplastics and thus do not require curing or vulcanization. Thermoplastic elastomers utilize physical cross-links, contrary to conventional vulcanized rubber having a stable three dimensional structure, in which a polymer and a vulcanizer form a covalent bond. The physical cross-links enable thermoplastic elastomers to be easily molded by the same fusion heating process as is applied to conventional thermoplastic resins. Therefore, it is not necessary that the thermoplastic elastomers employ a complicated vulcanizing and molding process including preforming.

Sleeve 34 is preferably configured with four surfaces designated 36, 38, 40 and 42 in the drawings, which substantially match the four surfaces 18, 20, 22 and 24 of gripping portion 16 of handle or body portion 11. First, second, third and fourth surfaces 36, 38, 40, 42 of sleeve 34 preferably complementally contact annular collar 14. First and second surfaces 36, 38 of sleeve 34 are preferably parallel with one another and spaced from one another in the same manner as first and second surfaces 18, 20 of gripping portion 16 of handle or body portion 11 of brush 10. First and second surfaces 36, 38 of sleeve 34 preferably include apertures 44 which are sized for complemental fitting about raised central facing surface portions 26 of parallel spaced first and second surfaces 18, 20 of gripping portion 16.

Fourth surface 42 of sleeve 34 preferably includes a plurality of preferably transversely extending sacrificial protrusions 46 formed on the exterior thereof. Protrusions 46 are at least substantially equally spaced from one another along fourth surface 42 of sleeve 34 in the vicinity of juncture of fourth surface 42 with annular collar 14 when sleeve 34 is positioned on handle or body portion 11, so that sacrificial protrusions 46 may make erasing contact with the suede shoe surface or other suede surface to be cleaned.

The operation of the shoe brush 10 combines the properties of the eraser sleeve 34 with the brush effect of the bristles 32. Specifically, a mark or stain on the suede material, or other napped material, is erased using the, eraser sleeve 34 while attached to the handle or body portion 11. Alternatively, the sleeve may be removed from the body portion 11 so as to allow placement of the index, or other, finger into the inside concave contour of the sleeve located just behind the area having sacrificial protrusions 46, thereby allowing a greater control over the amount of and pressure of the applied force. Thereafter, the shavings of the eraser sleeve 34 and particles of the suede material, or other napped material, including the stain or mark, are brushed away by bristles 32.

Brush 32 may be fabricated from, for example without limiting the invention, polymeric materials, namely fairly high strength engineering polymers such as polycarbonate, acrylonitrile butadiene styrene, and fiber reinforced composites. Polymer material, such as a block co-polymer including, but not limited to, styrenes (for example styrene-ethylene-butadiene-styrene, or styrene-butadiene-styrene), polyolefins (for example polypropylene/ethylene propylene), diamine modified systems (for example synthetic rubber), polyamides (for example polyamide 2 or polyamide 6), polyesters (for example polyester ester or polyether ester), polyurethanes (for example polyesterurethane, polyetherurethane or polyesteretherurethane) are also contemplated. In alternative aspects of the invention the brush can be molded from polyolefins such as polypropylenes and polyethylenes, polyamides such as nylons, and polyesters such as polyethylene terephthalate. Other suitable materials include polymethylmethacrylate, styrene acrylonitrate and cellulose esters, for example cellulose propionate.

It is to be understood that the brush assembly of the present invention may be manufactured in configurations other than those shown herein. All of such modifications and variations are within the scope of the present invention, and in view of the disclosure herein numerous other modifications and variations may be implemented by one of skill in the art. The foregoing drawings, discussion and description are illustrative of particular embodiments of the invention and are not meant to be limitations upon the practice thereof. It is the following claims, including all equivalents, which define the scope of the invention.

The invention claimed is:

1. A brush for suede shoes and the like, comprising:

a. a one-piece molded plastic handle having a hollow interior and comprising:

i. a planar outwardly facing bristle mounting surface;

ii. a collar extending annularly about said mounting surface;

iii. a gripping portion extending centrally from said collar transversely oppositely of said bristle mounting surface, having three generally vertically extending surfaces, two of which are parallel and spaced from one another with a third surface joining each of said parallel surfaces, and a convex, curved fourth surface extending upwardly and wherein said fourth surface transitions into said third surface at a position maximally remote from said bristle mounting surface, said parallel spaced surfaces each including generally centrally positioned exteriorly facing surface portions raised from the area therearound with areas of depression formed in said exteriorly facing surface portions therein facilitating manual gripping of said brush, said fourth surface including a plurality of transversely extending protrusions formed thereon, substantially equally spaced from one another along said fourth surface from said collar to said transition into said third surface;

b. bristles embedded in and extending outwardly from said bristle mounting surface;

c. a hollow removable erasing rubber sleeve configured with four surfaces substantially matching said four surfaces of said gripping portion, for essentially complemental fitting over said gripping portion of said molded plastic handle and complementally contacting said collar and including apertures in said parallel surfaces sized for complemental fitting about said raised exteriorly facing surface portions of said parallel spaced surfaces of said gripping portion, a fourth one of said surfaces of said sleeve including a plurality of transversely extending sacrificial protrusions formed thereon, substantially equally spaced from one another along said fourth surface of said sleeve proximate juncture thereof with said collar for erasing contact with a suede shoe surface to be cleaned.

2. A brush for suede shoes, comprising:

a. a handle comprising:

i. an outwardly facing bristle mounting surface;

ii. a removable erasing sleeve;

iii. a gripping portion extending away from said bristle mounting surface, including at least one exterior first surface fitment, including a plurality of protrusions formed thereon for retaining and resisting sliding removal of said erasing sleeve, the sleeve being adapted for removably fitting over said handle, when said sleeve is over said handle and engaging said fitment;

b. said bristles being mounted on and extending from said bristle mounting surface;

c. said removable erasing sleeve being configured for fitting over and complementally contacting said gripping portion and including at least one second fitment formed therein for engaging said first surface fitment of said gripping means and precluding sliding removal of said sleeve from the position fitting over said gripping portion.

3. The brush of claim 2 wherein said bristles mounted on and extending outwardly from said bristle mounting surface vary in length as respective bristle location along at least one direction in which said mounting surface extend to provide a wave-like configuration of the outwardly extending bristle ends opposite bristle ends at said mounting surface.

4. The brush of claim 2 further comprising at least one sacrificial protrusion formed on said erasing sleeve for sacrificial erasing contact with a suede shoe surface to be cleaned.

5. The brush of claim 1 further comprising a plurality of sacrificial protrusions formed on said erasing rubber sleeve, substantially equally spaced from one another along said fourth surface of said sleeve proximate juncture thereof with said collar for erasing contact with a suede shoe surface to be cleaned.

6. The brush of claim 2 wherein said sleeve is rubber.

7. The brush of claim 2 further comprising a collar extending at least partially around said mounting surface.

8. The brush of claim 2 wherein said bristles are embedded in said bristle mounting surface.

9. A brush for suede shoes and the like, comprising:

a. a handle comprising:

i. an outwardly facing bristle mounting surface;

ii. a collar extending at least partially around said bristle mounting surface;

iii. a gripping portion extending centrally from said collar oppositely of said bristle mounting surface, having a plurality of exteriorly facing surfaces extending away from said bristle mounting surface and bristles mounted in the bristle mounting surface, first and second surfaces of said gripping portion being spaced from one another with a third surfaces of said gripping portion joining each of said first and second surfaces of said gripping portion, a fourth surface of said gripping portion extending upwardly and transitioning into at least said third surface of said gripping portion at a position maximally remote from said bristle mounting surface, said first and second surfaces of said gripping portion each including exteriorly facing raised surface portions for retaining an erasing sleeve when positioned complementally over said handle, said fourth surface of said gripping portion including a plurality of protrusions formed thereon, substantially equally spaced from one another along said fourth surface of said gripping portion from said collar for resisting sliding removal of said sleeve when positioned over said handle and engaging said raised surface portions;

b. said bristles being embedded in and extending transversely outwardly from said bristle mounting surface, said bristles varying in length with bristle position along at least one direction in which said mounting surface extends to provide a wave-like configuration of outwardly extending bristle ends which are opposite those bristle ends embedded in said mounting surface;

c. a removable erasing sleeve configured to slide over and substantially complementally contact said outer surface of said gripping portion, said sleeve including an annular edge configured to contact said collar, said sleeve having receptacles formed therein for receiving said raised exteriorly facing surface portions of said parallel spaced surfaces to retain said sleeve in position on said handle.

10. The brush of claim 9 wherein said sleeve further comprises a plurality of externally facing sacrificial protrusions formed thereon, substantially equally spaced from one another and positioned on a surface of said sleeve which overlies said fourth surface of said gripping portion when said sleeve is in position complementally contacting said gripping portion, for erasing contact with a suede shoe surface to be cleaned.

11. The brush of claim 10 wherein said sleeve is rubber.

12. The brush of claim 9 wherein at least one of said exteriorly facing surfaces extending away from said bristle mounting surface are parallel with one another.

13. The brush of claim 9 wherein said bristle mounting surface is planar.

14. The brush of claim 12 wherein said first and second surfaces of said exteriorly facing surfaces extending away from said bristle mounting surface are parallel with one another.

15. The brush of claim 9 further comprising areas of depression formed in said raised surface portions facilitating manual gripping of said brush thereat.

16. The brush of claim 9 wherein said sleeve has a plurality of exteriorly facing sleeve surfaces extending away from said bristle mounting surface when said sleeve is positioned on said handle, first and second sleeve surfaces of said sleeve being spaced from one another with a third sleeve surface of said sleeve joining each of said first and second sleeve surfaces, a fourth sleeve surface extending upwardly and transitioning into at least said third sleeve surface at a position maximally remote from said bristle mounting surface, when said sleeve is positioned on said handle, said spaced first and second sleeve surfaces each including apertures for fitting over exteriorly facing raised portions on said first and second surfaces of said handle for retaining said sleeve in position complementally over said handle, said fourth sleeve surface including a plurality of sacrificial cleaning protrusions formed thereon, substantially equally spaced from one another along said fourth surface.

17. The brush of claim 9 wherein said sleeve is sized and shaped for complemental, facing contact fitting over said gripping portion.

18. The brush of claim 17 wherein said sleeve further comprises apertures formed in said parallel surfaces thereof which are sized for complemental fitting about said raised surface portions of said handle.

19. The brush of claim 9 wherein a. said sleeve further comprises a plurality of sacrificial protrusions formed thereon, substantially equally spaced from one another along said fourth surface extending upwardly and transitioning into said third surface for erasing contact with a suede shoe surface to be cleaned;

b. said sleeve is rubber;

c. at least one of said exteriorly facing surfaces extending away from said bristle mounting surface are parallel with one another;

d. said bristle mounting surface is planar;

e. said first and second surfaces of said exteriorly facing surfaces extending away from said bristle mounting surface are parallel with one another;

f. there are areas of depression formed in said raised surface portions facilitating manual gripping of said brush thereat;

g. said sleeve has a plurality of exteriorly facing surfaces extending away from said bristle mounting surface when said sleeve is positioned on said handle, first and second sleeve surfaces being spaced from one another with a third sleeve surfaces joining each of said first and second sleeve surfaces, a fourth sleeve surface extending upwardly and transitioning into at least said third sleeve surface at a position maximally remote from said bristle mounting surface, when said sleeve is positioned on said handle, said spaced first and second sleeve surfaces each including apertures for fitting over said exteriorly facing raised portions on said first and second surfaces of said handle for retaining said sleeve in position complementally over said handle, said fourth sleeve surface including a plurality of sacrificial cleaning protrusions formed thereon, substantially equally spaced from one another along said fourth surface; and h. said sleeve is sized and shaped for complemental, facing contact fitting over said gripping portion and further comprises apertures formed in said parallel surfaces thereof which are sized for complemental fitting about said raised portions of said handle.

20. A brush for suede shoes and the like, comprising:

a. a handle of generally shark-tooth configuration, comprising:

i. an outwardly facing bristle mounting surface;

ii. a shark-tooth shaped gripping portion extending oppositely of said bristle mounting surface b. bristles embedded in and extending outwardly from said bristle mounting surface; and c. a removable erasing sleeve configured to substantially complementally contact and fit over said gripping portion of said handle, said removable erasing sleeve including an annular edge which adjoins said bristle mounting surface about the periphery thereof when said sleeve is in complemental contact with and fitting over said gripping portion of said handle.

21. The brush of claim 20 wherein said handle portion further comprises a plurality of exteriorly facing surfaces extending away from said bristle mounting surface, first and second ones of said exteriorly facing surfaces being generally planar and parallel with but spaced from one another, with a third surfaces being generally planar, transverse to and joining each of said first and second surfaces, a fourth surface being curved and transitioning into at least said third surface at a position maximally remote from said bristle mounting surface, said first and second surfaces each having a curved boundary joining said fourth surface along respective curved parallel edges thereof.

22. The brush of claim 20 wherein said sleeve further comprises a plurality of exteriorly facing surfaces extending away from said bristle mounting surface when said sleeve is positioned on said handle, first and second sleeve surfaces being generally planar and parallel with but spaced from one another, with a third sleeve surface being generally planar, transverse to and joining each of said first and second sleeve surfaces, a fourth sleeve surface being curved and transitioning into at least said third sleeve surface at a position maximally remote from edges of said sleeve surfaces which are proximate to said bristle mounting surface when said sleeve is positioned on said handle, said spaced first and second sleeve surfaces each having a curved boundary joining said fourth sleeve surface along respective curved parallel edges thereof.

23. The brush of claim 20 wherein said handle comprises an annular collar surrounding said bristle mounting surface and said sleeve is configured to contact said annular collar when positioned on said handle in complemental facing contact therewith and said sleeve includes receptacles formed therein receiving raised exteriorly facing surface portions extending from parallel spaced surfaces of said handle to retain said sleeve in position on said handle.

24. The brush of claim 20 wherein bristle lenght varies with bristle position along at least one direction in which said mounting surface extends to provide a wave-like configuration outwarly extending of bristle ends which are opposite those bristle ends embedded in said mounting surface.

25. A brush for suede, comprising:

a. a shark-tooth shaped handle comprising:

i. an outwardly facing bristle mounting surface;

ii. a shark-tooth shaped hollow gripping portion extending oppositely of said bristle mounting surface, having a plurality of exteriorly facing surfaces extending away from said bristle mounting surface, first and second ones of said plurality of exteriorly facing surfaces being generally parallel and spaced from one another with a third surfaces being generally transverse to and joining each of said first and second surfaces, a fourth surface being curved and transitioning upwardly into at least said third surface remote from said bristle mounting surface, said spaced first and second surfaces each curvingly adjoining said third and said fourth surfaces and including exteriorly facing raised surface portions for retaining an erasing sleeve when positioned complementally over said handle;

b. bristles extending outwardly from said bristle mounting surface; and c. a removable erasing sleeve configured to substantially complementally contact said outwardly facing bristle mounting surface of said gripping portion with an annular edge of said sleeve adjoining said bristle mounting surface about the periphery thereof when said sleeve is in position on said handle.

26. The brush of claim 25 wherein said sleeve further comprises a plurality of exteriorly facing surfaces extending away from said bristle mounting surface when said sleeve is positioned on said handle, first and second sleeve surfaces being generally parallel and spaced from one another with a third sleeve surfaces being generally transverse to and joining each of said first and second sleeve surfaces, a fourth sleeve surface being curved and transitioning upwardly into at least said third sleeve surface remote from said bristle mounting surface, said spaced first and second sleeve surfaces each curvingly adjoining said third and said fourth sleeve surfaces and including apertures for receiving said exteriorly facing raised surface portions on said handle surfaces for retaining said erasing sleeve in position complementally on said handle.

27. The brush of claim 25 wherein said fourth surface of said handle includes a plurality of protrusions formed thereon for resisting sliding removal of said sleeve when said sleeve is positioned over said handle and engages said raised surface portions.

28. The brush of claim 27 wherein said protrusions are substantially equally spaced from one another along said fourth surface.

29. The brush of claim 25 wherein said bristles are of length which varies with bristle position along at least one direction in which said mounting surface extends to create a wave-like apperance of outwarly extending bristle ends which are opposite those bristle ends locate at said mounting surface.

30. A brush comprising:

a. a handle having a gripping portion extending away from a bristle mounting surface;

b. bristles embedded in and extending outwardly from said bristle mounting surface; and c. a removable erasing sleeve configured to substantially complementally contact an outer surface of said gripping portion, and including an annular edge which adjoins said bristle mounting surface about the periphery thereof.

31. The brush of claim 30 wherein a plurality of brush bristles are embedded in and mounted on said bristle mounting surface, said brush bristles forming a substantially flat bristle surface.

32. The brush of claim 30 wherein a plurality of brush bristles are embedded in and mounted on said bristle mounting surface, said brush bristles forming a substantially wave-like configuration of bristle ends.

33. The brush of claim 30 wherein at least one sacrificial protrusion is on said erasing sleeve for sacrificial erasing contact with a surface to be cleaned.

34. The brush of claim 30 wherein said bristles have frayed ends.

35. The brush of claim 30 wherein said bristles are rigid.

36. The brush of claim 30 wherein said gripping portion comprises:

a. two parallel surfaces spaced from one another, with a third surface joining each of said parallel surfaces;

b. said gripping portion further comprises a convex, curved fourth surface extending upwardly and transitioning into said third surface at a position maximally remote from said bristle-mounting surface;

c. said parallel spaced surfaces each comprising centrally positioned exteriorly facing surface portions raised from an area therearound with said centrally positioned exteriorly facing surface portions including areas of depression, said areas of depression facilitating manual gripping of said brush;

d. said fourth surface comprises a plurality of transversely extending protrusions formed thereon, said protrusions are substantially equally spaced from one another along said fourth surface.

* * * * *